United States Patent [19]

Newkirk et al.

[11] 4,145,469

[45] Mar. 20, 1979

[54] WATER-INSOLUBLE TREATED TEXTILE AND PROCESSES THEREFOR

[75] Inventors: David D. Newkirk; Robert B. Login, both of Woodhaven, Mich.

[73] Assignee: BASF Wyandotte Corporation, Wyandotte, Mich.

[21] Appl. No.: 841,165

[22] Filed: Oct. 11, 1977

[51] Int. Cl.[2] ..... B32B 7/00

[52] U.S. Cl. ..... 428/245; 427/341; 427/390 C; 428/263; 428/265; 428/272; 428/395

[58] Field of Search ..... 427/341, 390 C; 428/395, 224, 225, 245, 272, 265, 260, 263; 260/75 P, 29.2 E, 978, 980

[56] References Cited

U.S. PATENT DOCUMENTS

| | | | |
|---|---|---|---|
| T949,068 | 8/1977 | Pacifici | 427/341 |
| 3,288,631 | 11/1966 | Jorder | 427/333 |
| 3,415,788 | 12/1968 | Jedlicka | 260/75 |
| 3,546,008 | 12/1970 | Shields | 428/395 |
| 3,734,874 | 5/1973 | Kibler et al. | 260/29.2 E |
| 3,779,993 | 12/1973 | Kibler et al. | 260/75 P |
| 3,907,736 | 9/1975 | Barton et al. | 260/29.4 R |

*Primary Examiner*—Ronald H. Smith
*Assistant Examiner*—Janyce A. Bell
*Attorney, Agent, or Firm*—Andrew E. Pierce; Bernhard R. Swick; Robert E. Dunn

[57] ABSTRACT

There are disclosed processes for preparing a textile treated with a water-insoluble polyester wherein a linear or branched chain water-soluble sulfonate or phosphate group containing polyester is coated or impregnated onto a textile substrate in combination with a crosslinking agent and subsequent to heating to co-react the crosslinking agent with the polyester, the treated textile substrate is exposed to an aqueous solution of a polyvalent metal ion reactive with said sulfonate or phosphate groups in said polyester.

Alternatively, there are disclosed processes for preparing a water-insoluble polyester on a textile substrate wherein a branched chain polyester having sulfonate or phosphate groups is coated or impregnated onto a textile substrate, the substrate is dried and subsequently exposed to an aqueous solution of a polyvalent metal ion reactive with said sulfonate or phosphate groups in said polyester.

The processes disclosed herein are useful in the preparation of nonwoven fabrics and finished woven fabrics such as sized fabrics including use as a pigment binder in sizing woven fabrics.

16 Claims, No Drawings

WATER-INSOLUBLE TREATED TEXTILE AND PROCESSES THEREFOR

BACKGROUND OF THE INVENTION

1. Field of the Invention

The present invention relates to processes for insolubilizing polyester coated and impregnated textiles made using water-soluble polyesters.

2. Description of the Prior Art

Water-dispersible polyesters containing either sulfonate or phosphate groups are known. Phosphorus-containing low molecular weight polyesters are known from U.S. Pat. No. 3,415,788 for use in protective coatings for metal surfaces. These are corrosion resistant compositions which are liquids at ambient temperatures which are primarily used as coatings on metal surfaces. The coatings are hardened by baking at a temperature of about 100° to 400° F. to inhibit corrosion. These prior art polyesters are prepared by reacting a benzene polycarboxylic reactant, preferably trimellitic anhydride with a polyhydroxy compound such as a polyhydroxy aliphatic or aromatic alcohol phenol together with a phosphorus acid reactant such as phosphorus pentoxide or phosphoric acid.

Sulfur-containing, water-dispersible polyesters are disclosed in U.S. Pat. No. 3,546,008 for use as sizing compositions on textile yarn. These polyesters are prepared by reacting a dicarboxylic acid component, a diol and a difunctional monomer containing a $—SO_3M$ group attached to an aromatic nucleus wherein M is hydrogen or an alkali metal ion. Replacement by ion exchange of the alkali metal ion utilized with calcium, magnesium, cuprous, ferrous and ferric ions is disclosed as a means of modifying the properties of the polyester in column 4, lines 17–23 but there is no indication that insolubilization results thereby. Similar disclosures are in U.S. Pat. No. 3,779,993, column 3, lines 61–75 and column 4, lines 1–14 and U.S. Pat. No. 3,734,874, column 3, lines 67–75 and column 4, lines 1–20 wherein it is disclosed that when divalent and trivalent ions are used in the polyester, it becomes less easily dissipated in cold water but more readily dissipated in hot water. However, in U.S. Pat. No. 3,907,736, said polyesters are disclosed as rendered water-dissipatable where M is an alkali metal.

In Defensive publication U.S. Patent Office T-No. 949,001, there is disclosed that textile finishes based upon water dispersible polyesters prepared using sodiosulfoisophthalic acid containing a monovalent metal cation can be treated with an aqueous solution of a polyvalent metal cation to increase the durability of the finish by making the finish less soluble in water. Thermally and radiation-crosslinked finishes as well as non-crosslinked finishes are rendered more durable by treatment with polyvalent metal cations.

In copending commonly assigned applications, Ser. No. 702,043, filed July 2, 1976, and Ser. No. 727,991, filed Sept. 30, 1976, now U.S. Pat. No. 4,098,741 water-dispersible, branched chain polyester size compositions are disclosed respectively containing a sulfonate group or a phosphate group as an integral part of the polymer chain so as to confer upon said polyesters when neutralized the property of water dispersibility which property is normally retained subsequent to coating or impregnating a textile fiber with said polyester as in a sizing process.

In no one of the above references is there any suggestion or disclosure that the branched chain polyester compositions used in the process of this invention can be rendered insoluble by contacting said polymer with a polyvalent metal salt or alternatively that the water solubility of co-reacted polyesters and thermosetting resin cross-linking agents can be reduced by contacting with a polyvalent metal salt.

SUMMARY OF THE INVENTION

The present invention is based upon the surprising discovery that when certain water-soluble, branched chain polyesters of the prior art containing neutralized $SO_4$ groups or neutralized $-PO_4$ groups wherein said neutralized polyesters are neutralized with an amine or a monovalent alkali metal salt or hydroxide and wherein said groups form an integral part of the polymer chain, are contacted with an aqueous solution of a polyvalent metal ion reactive with said sulfonate or phosphate groups that the inherent water solubility of said polyesters is lost and said polyesters become insoluble in water.

The insolubilization process disclosed is also effective to improve the water resistance of sulfonate and phosphate group-containing polyesters of the prior art which have been previously co-reacted with thermosetting resins or blends of said polyesters used with conventional textile finishing agents such as polyvinyl alcohol and starch with or without thermosetting resins.

In accordance with this invention there are provided treated textile products obtained by (1) processes for preparing non-woven fabrics, for instance, prepared by saturation-binding of polyester staple fibers and (2) processes for preparing finished woven fabrics wherein increased body and modification of the "hand" or "handle" of such woven fabrics is obtained, particularly with polyester fabrics or wherein the textile finish, in addition to sizing the textile fabric, acts to bind pigments used to color the fabric.

DETAILED DESCRIPTION OF THE INVENTION AND THE PREFERRED EMBODIMENTS

Water-soluble or water-dispersible sulfonate or phosphate group-containing polyester resins are known in the prior art. The solubility of said polyesters is a function, for instance, of the presence, as an integral part of the polymer chain, of solubilizing groups such as $—SO_3M$ or $—PO_3M$ wherein M is selected from the group consisting of a monovalent alkali metal. Neutralization of the free acid form of the polyester can also take place using bases such as ammonia or an amine to confer water-solubility. It has now been discovered that certain branched chain polyesters of the prior art can be rendered water-insoluble by contacting said polyesters with a polyvalent metal ion. For the purposes of this specification and claims, the term "water soluble" when used to describe the polyesters utilized in the processes of this invention, also includes those termed "water-dispersible" in the prior art.

Said polyvalent metal ion can be present as an aqueous solution of a salt thereof. Typically, the water is removed therefrom either by exposure to ambient or elevated temperatures. Such process provides a means of increasing the durability in textile applications of a water-soluble polyester size composition utilized on fibers. For instance, improved durability of a polyester composition can be obtained where said polyester is used as a binder for staple fibers as in the preparation of a non-woven fabric or where such polyester is used either alone or in combination with other prior art finishing agents for woven textiles, for instance, to confer body or "hand" to said fabric or where used as a pigment binder to fix a colored pigment to the surface of a textile material. Alternatively, the insolubilization process of the invention can be used to further increase the durability of sizes and coatings of both linear and branched chain sulfonate and phosphate group-containing water-soluble polyesters which are coreacted with thermosetting resins.

The method disclosed of insolubilizing water-soluble polyester compositions is generally applicable to any water-soluble polyester resins containing $—SO_3M$ groups or $-PO_3M$ groups as an integral part of the polymer chain wherein M is as previously defined. It is preferred to utilize the polyester compositions further described below which are disclosed in copending, commonly owned applications, Ser. No. 702,043, filed July 2, 1976, and Ser. No. 727,991, filed Sept. 30, 1976, the disclosures of which copending applications are hereby incorporated by reference.

A. Sulfonate salt-containing, branched chain polyester where the sulfonate salt group is attached to an aromatic nucleus through an aliphatic chain and ester linkage An exemplary class of water-soluble branched chain polyester which can be insolubilized by the process of the invention contains sulfonate salt groups forming an integral part of the polymer chain wherein said sulfonate salt group is attached to an aromatic nucleus of a carboxylic acid residue through an aliphatic chain and ester linkage. Said linkage contains about 2 to about 8 carbon atoms. Such polyesters, which are disclosed in copending commonly assigned application Ser. No. 702,043, filed July 2, 1976, are prepared by reacting in a single reaction vessel a diol with an aromatic dicarboxylic acid, anhydride, acyl halide or ester derivative thereof in the presence of a hydroxy-sulfonic acid metal salt.

The useful hydroxysulfonic acid metal salts which are used to confer water-solubility upon the polyester can be prepared from appropriate acids as described hereinafter and correspond to the general formula:

$$HO — Q — SO_3M$$

wherein M is an alkali metal and Q is a bivalent aliphatic or cycloaliphatic, saturated or unsaturated hydrocarbon radical having about 2 to about 8 carbon atoms. Said radical has valence bonds on different carbon atoms and can contain halogen substituents. Especially useful hydroxy aliphatic hydrocarbon sulfonic acids are: 2-hydroxyethanesulfonic acid (isethionic acid) and 2-hydroxyl-1-propane sulfonic acid.

Preferably the hydroxysulfonic acids useful in the preparation of the branched chain water-soluble polyesters are reacted with a polyfunctional aromatic carboxylic acid anhydride or mixtures thereof and a diol. Preferably the mono- or difunctional reaction product which is obtained is reacted with other dicarboxylic acids which can be aromatic or aliphatic in order to obtain a suitable balance of physical properties in the polyester. The hydroxysulfonic acids are preferably used in the form of their metallic salts such as the sodium, potassium and lithium salts. The hydroxysulfonic acid metal salts are readily prepared by neutralization of the corresponding sulfonic acid with an equivalent of an amine, ammonia or an alkali metal hydroxide or salt such as the carbonate, chloride, etc.

B. Phosphorus-containing Polyesters

Exemplary of the class of phosphorus-containing, branched chains, water-soluble polyesters useful in preparing the novel water insoluble polymers of the invention are those generally prepared in the free acid form which are usable as such or easily converted to water-dispersible, moisture-sensitive materials by neutralizing or partially neutralizing the free acid with a basic material such as an alkali metal carbonate, alkali metal hydroxide, ammonia or an amine. These polyesters are disclosed in copending, commonly assigned application Ser. No. 727,991, filed Sept. 30, 1976.

In preparing the phosphorus-containing polyester compositions, at least one diol or polyoxyalkylene glycol is generally first combined with at least one phosphorus acid reactant under conditions in which the diol or polyoxyalkylene glycol is present in large excess so as to provide a reaction product of a mixture of an excess of the diol or polyoxyalkylene glycol and the corresponding mono- and diphosphate esters. Subsequently, at least one dicarboxylic reactant is added to said reaction product and the mixture heated to facilitate condensation. The phosphate group-containing polyester obtained is a viscous liquid which can be cooled to form a very hard, strong, transparent plastic that readily disperses, for instance, in an aqueous solution of a dilute base such as an aqueous solution of sodium bicarbonate. Other alkali metal carbonates and bicarbonates can be used to disperse the polyester. Other bases such as amines or ammonia are also useful to render said polyesters water-dispersible. Illustrative amines are isopropylamine, n-propylamine, ethylamine and triethanolamine.

The phosphorus acid reactant utilized in the preparation of said polyesters can be phosphorus pentoxide, phosphoric acid or mixtures thereof. Pyrophosphoric acid and metaphosphoric acid as well as the various polyphosphoric acids, all of which are readily formed by mixing the proper amounts of water with phosphorus pentoxide, are useful. Aqueous solutions of phosphoric acid such as commercial 85% by weight phosphoric acid can be used; the lower concentration limit being limited as a practical matter by the compatibility and reactivity of the reactant.

In preparing the reaction product of the phosphorus acid reactant such as phosphorus pentoxide with a polyoxyalkylene glycol such as diethylene glycol, it has been found suitable to conduct the reaction in a first stage at ambient temperature by either slowly adding the phosphorus pentoxide to the glycol or alternatively dispersing the phosphorus pentoxide in an inert solvent such as methylene chloride or benzene and adding it to the glycol. The corresponding mono- and diphosphate esters are readily obtained with the necessity of heating the mixture or using a catalyst.

During the second stage of the process to produce the branched chain, phosphorus-containing polyester used in the process of the invention, the use of heat is involved, water being removed as a by-product during the reaction. In this stage, at least one dicarboxylic reactant such as isophthalic acid is reacted with the excess glycol present and the mono- and diphosphate esters formed previously. The conditions of heating are generally at a temperature of about 150° C. to about 250° C. over a time of about 1 hour to about 8 hours or until the desired carboxylic acid number is reached of about 2 to about 24.

C. The Polyvalent Metal Ion Insolubilizing Agent

The polyvalent metal ion of the invention can be at least one of any polyvalent metal ion reactive with sulfonate or phosphate groups present in the water-soluble polyester composition described above. Representative polyvalent metal ions which are useful as insolubilizing agents are selected from the group consisting of at least one of calcium ($Ca^{++}$), magnesium ($Mg^{++}$), aluminum ($Al^{+++}$), cobalt (cobaltous, $Co^{++}$ and cobaltic, $Co^{+++}$) and ferric ($Fe^{++}$) ions. Such polyvalent metal ions can be derived from the above metal halide salts, the above metal oxides, the above metal hydroxides and the above metal carbonates.

As previously described, it is only necessary that the polyester be contacted with one species of polyvalent metal ions or mixtures thereof for insolubilization to occur. This can take place by passing the above-described polyester size or coatings, after application to a woven textile or a non-woven fabric substrate through an aqueous solution of a polyvalent metal ion capable of reacting with said sulfonate or phosphate groups on said polyester. Generally, based upon the weight of the polyester present on the textile substrate, about 0.05% to about 2% by weight solids aqueous solutions of the polyvalent metal ion are required for effective insolubilization. Preferably about 0.05% to about 1% solids by weight and most preferably about 0.05 to about 0.5% solids by weight is used. The insolubilization reaction takes place upon similar contact of the polyester resin with the polyvalent metal ion in an aqueous solution at ambient or elevated temperatures such that upon withdrawal of the polyester coated or impregnated textile, the polyester on the textile substrate is no longer soluble on subsequent exposure to water.

The water resistance of said polyesters can also be improved where said polyesters have been previously co-reacted with a cross-linking agent reactant such as a thermosetting resin, preferably a thermosetting synthetic resin, in order to improve the durability of said polyester size or coating. For instance, melamine or urea-formaldehyde-based thermosetting resins such as tetramethyl acetylene diurea, dimethylol dihydroxyethyleneurea or dimethylol ethylene urea can be reacted in combination with said polyesters at elevated temperatures to provide a nominal degree of water resistance. The co-reaction is preferably conducted in the presence of an acid catalyst as is well known to those skilled in the art or a catalyst splitting off an acid, for example, ammonium nitrate or sulfate. Generally a textile substrate is treated by coating or impregnating said substrate with an aqueous solution of said polyesters and thermosetting resins, excess amounts of treating agent is squeezed off the fabric and the treated substrate subsequently heated to a temperature of between 120°-160° C. for a period of time sufficient to dry and substantially cross-link the thermosetting resins and the hydroxyl or carboxyl groups of the polyester described above.

Subsequent to treatment of the above described polyester with the thermosetting resins, as described above, the water insolubility or durability of the coated or impregnated textile substrate can be improved by passing said substrate through an aqueous solution containing at least one species of polyvalent metal ions.

The following examples illustrate the various aspects of the invention but are not intended to limit it. Where not otherwise specified throughout this specification and claims, temperatures are in degrees centigrade and all parts, percentages and proportions are by weight.

EXAMPLE 1

A branched chain polyester was prepared in accordance with the procedure disclosed in copending commonly assigned application Ser. No. 727,991, filed Sept. 30, 1976 in the U.S. Patent Office. Following the procedure of Example 13 in said commonly assigned application except that the polyester was made with a weight ratio of 15.4 to 78.0 to 100.3 respectively of 85% by weight phosphoric acid, diethylene glycol and isophthalic acid, the reaction was continued until a carboxylic acid number of 9.0 and a total acid number (including phosphoric acid, esters and carboxylic acid number) of 48 was achieved. The polyester was treated with sodium carbonate and water followed by a stripping operation to produce a 30% solution.

EXAMPLE 2

A branched chain polyester was prepared in accordance with the procedure of Example 1 in commonly assigned copending application Ser. No. 727,991, filed Sept. 30, 1976, which is hereby incorporated by reference except that a weight ratio of 9.5 to 78.0 to 100 respectively of $P_2O_5$, diethylene glycol and isophthalic acid was used and reaction was continued until a carboxylic acid number of 6 and a total acid number of 32 was achieved.

EXAMPLE 3

Example 2 was repeated except that polyphosphoric acid was used as the phosphate source, a weight ratio of 8.1 to 73.7 to 90 respectively of polyphosphoric acid, diethylene glycol and isophthalic acid was used, and reaction was continued to a carboxylic acid number of 6.4 and total acid number of 47.1.

EXAMPLE 4

A nonwoven fibrous mat of uncombed staple polyester fiber sold under the trademark "KODEL 411" was impregnated with an aqueous solution containing 10% by weight of the polyester prepared in Example 2. After preparation of the nonwoven mat, the excess solution was poured off and the mat was dried using low heat in an oven at a temperature of approximately 50° C. The resulting mat was cut into strips measuring approximately 6 inches by ¼ inch by ½ inch. A sample soaked in 0.85% by weight aqueous calcium chloride showed only slight swelling, the solution was clear and the sample was much stronger than samples placed in distilled water and almost equal to samples that had not been placed in distilled water.

EXAMPLES 6 and 7

Controls — Forming No Part Of This Invention

Example 4 was repeated but instead of soaking the samples prepared in the above Example in calcium chloride solution, samples were soaked in distilled water, sodium carbonate (0.9% by weight) and sodium chloride (0.9% by weight) solutions. Those samples soaked in distilled water were moderately swollen. The water in which they were soaked are cloudy but the fiber mat was resistant to mild attempts to pull it apart and could support its own weight.

The samples soaked in sodium carbonate and sodium chloride solutions were similar in strength to those soaked in distilled water.

EXAMPLES 8 and 9

A nonwoven fiber mat was made as in Example 4 by soaking polyester staple fiber in a solution of 4.5% by weight of a polyester prepared in Example 1. The excess solution was poured off and the sample dried by exposure to ambient temperature with an air flow of about 100 cubic feet per minute for a period of about 72 hours. It was determined that the nonwoven fiber mat contained 40.5% by weight polyester binder. The mat was cut into strips 10 centimeters by 2 centimeters by 0.4 centimeter and these strips were placed in various solutions and observations made upon the appearance of the solutions and of the strips both after about 50 minutes of exposure to the solution and after about 18 hours exposure. Aqueous solutions used were 0.1%, 0.25%, 0.5%, 0.85% and 1% (all by weight calcium chloride), and a magnesium sulfate solution containing 0.5% by weight of the salt. The samples soaked in the calcium chloride solution uniformly showed either no change in strength at the highest concentration of calcium chloride or some slight swelling at the lowest concentration of calcium chloride with the samples remaining relatively the same in condition after 50 minutes and after 18 hours. The samples soaked in the magnesium sulfate solution showed no change in strength after 50 minutes and 18 hours.

EXAMPLES 10 and 11

Controls — Forming No Part Of This Invention

Examples 8 and 9 were repeated except that the samples instead of being exposed to magnesium sulfate or calcium chloride solutions were exposed to an acetic acid solution with a pH of about 3.8 and a sodium carbonate solution containing 0.9% by weight of the salt. The samples generally showed extreme swelling and very low strength after 50 minutes as well as after 18 hours. The samples soaked in sodium carbonate exhibited significant swelling after 50 minutes and after 18 hours but was generally stronger than those samples treated with solutions of acetic acid.

EXAMPLE 12

Utilizing the polyester prepared in Example 3, an evaluation was made of the insolubilizing effects which result from the exposure of the polyester to a solution of calcium chloride subsequent to pre-reaction of said polyester with a partially methylated, triazine-based thermosetting resin, sold under the registered trademark "Aerotex" Resin 3730. In the first step, the polyester, thermosetting resin and ammonium sulfate catalyst were mixed in the respective weight ratio of 10:1:0.2. A 7% solids dispersion in water on a weight basis was prepared of the aforesaid ingredients and 1% by weight of a yellow pigment believed to be a member of the class of azo pigments known as diarylide yellow, was added thereto.

A sample of a polyester fabric sold under the trademark "Dacron" was cut into 12 inch by 6 inch pieces and after singing the edges to avoid raveling, the pieces were weighed and the above treating solution applied thereto. The fabric was subsequently allowed to air dry for about 2 hours. The samples were then cured in an oven for about 90 seconds at a temperature of 130° C. The samples were conditioned at room temperature for about an hour before determining the percent "add-on". A 7 to 10% by weight add-on was obtained in the samples.

In the second step, the samples were placed in a 0.5% by weight calcium chloride solution under agitation for a period of 10 minutes. The samples were then removed from the calcium chloride solution and allowed to air dry for about 2 hours prior to further evaluation.

The samples were then evaluated for colorfastness to perspiration (using a rapid control test) in accordance with AATCC 71-1956. This test method is a method for determining perspiration fastness of colored fabrics and is applicable to dyed or printed fabrics. Specifically, the test specimens are spotted with a specified perspiration solution, covered with a blotter and heated under a flatiron for 5 minutes. The blotter is then examined for transfer of color from the test specimen. Samples prepared above which were co-reacted with thermosetting resin and exposed to the calcium chloride solution as indicated above showed no staining and thus pass this test.

EXAMPLE 13

Control — Forming No Part Of This Invention

Example 12 was repeated except that samples which were co-reacted with thermosetting resin were not subsequently exposed to a solution of calcium chloride prior to evaluation in accordance with AATCC 71-1956 test method. These are stained and thus fail to pass the test.

EXAMPLE 14

Following the procedure disclosed in copending commonly assigned application Ser. No. 702,043, filed July 2, 1976, incorporated herein by reference, a sulfonate containing polyester is prepared generally in accordance with the procedure of Example 1 contained therein.

EXAMPLE 15

Utilizing the polyester prepared in Example 13, the procedure and proportions in Example 8 and 9 are repeated and a perspiration test run utilizing a polyester fabric specifically treated as indicated in Examples 8 and 9. There is obtained a treated fabric which passes the perspiration test (AATCC 71-1956). The perspiration test results show that samples prepared including treatment with a calcium chloride or magnesium sulfate solution pass the perspiration test without staining.

EXAMPLE 16

Control Forming No Part Of This Invention

Example 15 is repeated except that the samples are not treated by exposure to calcium chloride or magnesium sulfate solution. These samples show staining when evaluated according to test method AATCC 71-1956.

While this invention has been described with reference to certain embodiments, it will be recognized by those skilled in the art that many variations are possible without departing from the scope and spirit of the invention and therefore it is not intended that the invention be limited thereby.

What is claimed is:

1. A process for preparing a water-insoluble polyester product on a textile substrate comprising:
(a) forming a first aqueous solution comprising a cross-linking agent and at least one water-soluble phosphate group-containing branched chain polyester having $-PO_3M$ units wherein said units form an integral part of the polyester chain, and wherein M is selected from the group consisting of an alkali metal, ammonia, an amine, and combinations thereof,
(b) coating or impregnating a textile substrate with said aqueous solution of polyester and cross-linking agent reactants,
(c) heating the resultant substrate to cross-link said reactants and
(d) exposing said substrate to a second aqueous solution containing about 0.05% to about 2% by weight, based upon the weight of said polyester present on said substrate, of a polyvalent metal ion reactive with said phosphate groups in said polyester.

2. The process of claim 1 wherein said polyvalent metal ion is selected from the group consisting of at least one of $Ca^{++}$, $Co^{++}$, $Co^{+++}$, $Al^{+++}$, $Mg^{++}$ and $Fe^{+++}$ ions.

3. The process of claim 2 wherein said polyester and cross-linking agent in said first aqueous solution are coated or impregnated onto a fibrous mat substrate as a binder therefor to produce a non-woven fabric.

4. The process of claim 3 wherein said cross-linking agent is a thermosetting resin and said fibrous mat comprises a polyester yarn.

5. The product of the process of claim 1.

6. The product of the process of claim 3.

7. The process of claim 2 wherein said polyester and said cross-linking agent in said first aqueous solution are coated or impregnated onto a woven fabric substrate as a finish therefor.

8. The process of claim 7 wherein said finish additionally comprises a pigment.

9. The product of the process of claim 8.

10. A process for preparing a water-insoluble polyester product on a textile substrate comprising:
(a) forming a first aqueous solution comprising at least one water-soluble phosphate group-containing, branched chain polyester having $-PO_3M$ units wherein said units form an integral part of the polyester chain, and wherein M is selected from the group consisting of an alkali metal, ammonia, an amine, and combinations thereof,
(b) coating or impregnating a textile substrate with said aqueous solution of polyester,
(c) drying the resultant substrate and
(d) exposing said substrate to a second aqueous solution comprising about 0.05% to about 2% by weight, based upon the weight of said polyester present on said substrate, of a polyvalent metal ion reactive with said phosphate groups in said polyester.

11. The process of claim 10 wherein said polyvalent metal ions is selected from the group consisting of at least one of $Ca^{++}$, $Co^{++}$, $Co^{+++}$, $Al^{+++}$, $Mg^{++}$ and $Fe^{+++}$ ions.

12. The process of claim 10 wherein said polyester in said first aqueous solution is coated or impregnated onto a polyester fibrous mat substrate as a binder therefor to produce a non-woven fabric.

13. The product of the process of claim 10.

14. The product of the process of claim 12.

15. The process of claim 11 wherein said polyester in said first aqueous solution is coated or impregnated onto a woven fabric substrate as a finish therefor.

16. The process of claim 15 wherein said finish additionally comprises polyvinyl alcohol, starch or mixtures thereof.

* * * * *